US009657486B2

(12) United States Patent
Raymond

(10) Patent No.: US 9,657,486 B2
(45) Date of Patent: May 23, 2017

(54) DRYWALL SHEET REMOVAL TOOL

(71) Applicant: Paul Gregoire Raymond, Calgary (CA)

(72) Inventor: Paul Gregoire Raymond, Calgary (CA)

( * ) Notice: Subject to any disclaimer, the term of this patent is extended or adjusted under 35 U.S.C. 154(b) by 127 days.

(21) Appl. No.: 14/339,426

(22) Filed: Jul. 23, 2014

(65) Prior Publication Data

US 2016/0024807 A1 Jan. 28, 2016

(51) Int. Cl.
*B66F 15/00* (2006.01)
*E04G 23/08* (2006.01)

(52) U.S. Cl.
CPC ..... *E04G 23/08* (2013.01); *E04G 2023/085* (2013.01)

(58) Field of Classification Search
CPC B66E 15/00; B25B 5/00; B25B 5/163; B25B 13/32
See application file for complete search history.

(56) References Cited

U.S. PATENT DOCUMENTS 178,407 A * 6/1876 Butts ..... B25C 11/00 254/25
1,309,734 A * 7/1919 Hemfling, Sr. ..... B66F 15/00 254/131
1,793,060 A 3/1929 Clements
5,749,113 A 5/1998 Witter
6,260,824 B1 * 7/2001 Aderhold ..... B25C 11/00 254/113
7,753,342 B1 * 7/2010 Nolle ..... B25C 11/00 227/63
8,342,482 B2 * 1/2013 Smith ..... B66F 15/00 254/131.5
8,434,739 B1 5/2013 Connolly
8,567,760 B2 10/2013 Sindt
2002/0134971 A1 9/2002 Christensen
2010/0115705 A1 * 5/2010 Allen ..... B66F 15/00 7/166
2011/0036205 A1 2/2011 Pafumi

FOREIGN PATENT DOCUMENTS

CA 2453051 A1 4/2005
CN 203021267 6/2013
JP H0615532 1/1994

* cited by examiner

*Primary Examiner* — Lee D Wilson
(74) *Attorney, Agent, or Firm* — Richard D. Okimaw

(57) ABSTRACT

Disclosed herein are drywall sheet removal tools, comprising: a handle; and a plurality of tines; wherein an angle between a line of the handle and a plane defined by the plurality of tines is between 45° and 90°. Also disclosed are methods of removing a drywall sheet from a wall, the method comprising: creating an opening along the width of the drywall sheet; inserting a plurality of tines of a drywall sheet removing tool of claim 1 into the opening, such that the plurality of tines straddle a stud; and moving a handle of the tool in a direction opposite to a direction the tines are pointing.

9 Claims, 2 Drawing Sheets

DRYWALL SHEET REMOVAL TOOL

FIELD OF THE INVENTION

The present invention is in the field of tools, specifically home building tools.

BACKGROUND OF THE DISCLOSURE

During home remodeling and/or repairs, it becomes necessary to remove the old drywall sheets from the walls. Currently, this is accomplished by breaking up the drywall sheet with a sledgehammer or other blunt object and removing the pieces. This process is cumbersome and results in a great deal of debris and dust, which complicates the cleanup process and creates a health hazard for the worker who invariably breathes in the dust. Other removal methods include the use of a crowbar the pry the drywall sheet off of the wall studs. However, a crowbar does not provide enough leverage, which results in a greater force needed to be exerted to remove the sheet, and in the worker tire out relatively quickly. In addition, a crowbar focuses the force being exerted on a single point, which results in the sheet breaking up easily.

Therefore, there is a need in the art for a tool to be used to easily and efficiently remove drywall sheets.

SUMMARY OF THE INVENTION

Disclosed herein are drywall sheet removal tools, comprising: a handle; and a plurality of tines; wherein an angle between a line of the handle and a plane defined by the plurality of tines is between 45° and 90°. Also disclosed are methods of removing a drywall sheet from a wall, the method comprising: creating an opening along the width of the drywall sheet; inserting a plurality of tines of a drywall sheet removing tool of claim 1 into the opening, such that the plurality of tines straddle a stud; and moving a handle of the tool in a direction opposite to a direction the tines are pointing.

DETAILED DESCRIPTION OF THE EMBODIMENTS

The device disclosed herein comprises a forked claw, having at least two tines, and a long handle. The angle between the plane of the claw and the handle is between 45° and 90°, such that an efficient fulcrum is created.

Figure 1:
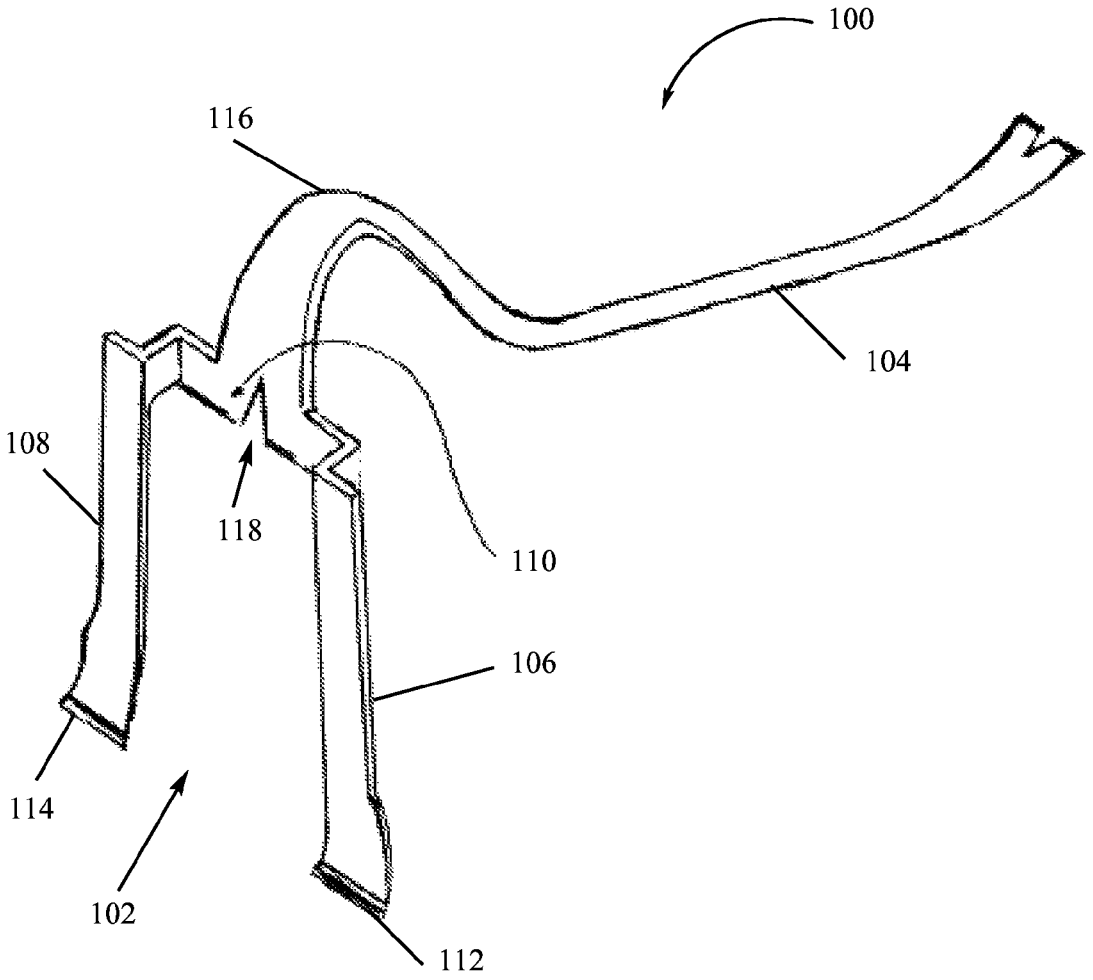
FIG. 1 is a drawing of an embodiment of the disclosed drywall sheet removal tool.

Referring to the drawings, FIG. 1 shows an embodiment of the presently disclosed drywall sheet removal tool 100. Tool 100 comprises a claw portion 102 and a handle 104. The claw portion 102 comprises a plurality of tines. The embodiment of FIG. 1 comprises two tines 106 and 108. In other embodiments, the claw portion 102 comprises three, four, five, six or more tines. In some embodiments, the distance between the tines 106 and 108 is two inches, or slightly wider, for example 2.125 inches, or 2.25 inches, whereas in other embodiments, the distance between the tines 106 and 108 is four inches, or slightly wider, for example 4.125 inches, or 4.25 inches. In yet other embodiments, the distance between the tines 106 and 108 is greater than four inches.

The width of the tines allows for the tines to straddle a wall stud, as discussed fully below. Thus, the width of about 2" is used when the sheet rock is nailed to the 2" side of a 2×4 stud, whereas the width of about 4" is used when the sheet rock is nailed to the 4" side of a 2×4 stud. In some embodiments, for example the one shown in FIG. 1, the plane where the handle attaches to the claws is offset from the plane of the tines. Thus, a wall stud can fit into the space defined by the tines 106 and 108 and the cross bar 110.

In some embodiments, the tines 106 and 108 are flat. In certain of these embodiments, the flat portion of the tines is in the generally distal section of the tines. In other embodiments, the entire length of each tie is flat. The flat tines are suitable for placing the tines behind the drywall sheet and provide a maximum contact area with the sheet for its removal.

In some embodiments, the tines 106 and 108 have sharp bladed edges 112 and 114, respectively. These sharp edges provide the means for a user to break through the drywall and create an opening into which the tines are inserted.

The handle 104 attaches to the claw portion 102 at the angle point 116. The angle of attachment at the angle point 116 is such that a fulcrum is created and the tool 100 provides a great degree of efficiency in its use. In some embodiments, the angle at the angle point 116, i.e., the angle between the line of the handle 104 and the plane of the claw portion 102, is between 45° and 90°. In certain embodiments, the angle at the angle point 116 is greater than 90°. In certain embodiments, the angle at the angle point 116 is less than 45°. In some embodiments, the angle at the angle point 116 is 90°.

In some embodiments, for example the one shown in FIG. 1, the angle point 116 has a curvature. This curvature increases the efficiency of the use of the tool 100.

In some embodiments, a wedge 118 is provided on the cross bar 110. The wedge 118 is used to remove any nails from the studs.

Figure 2:
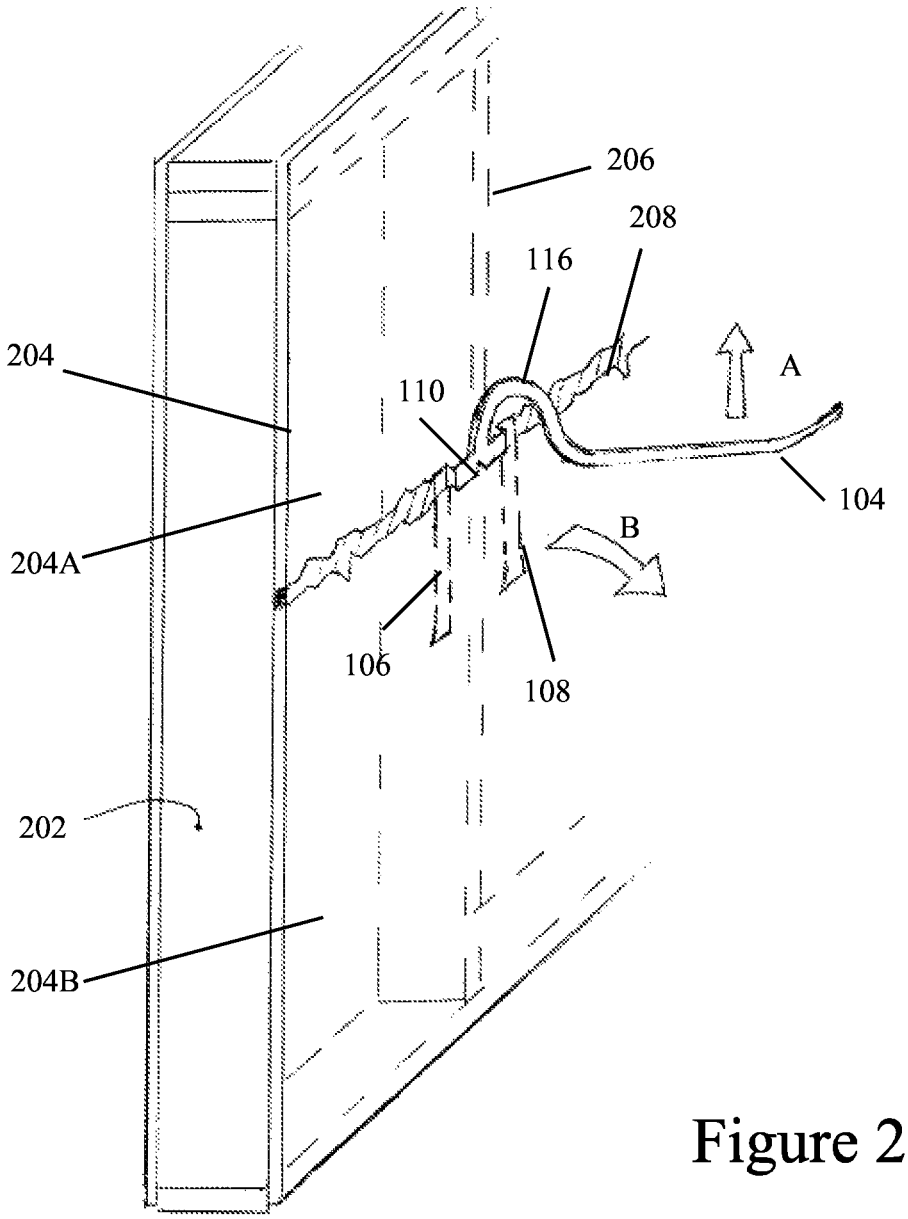
FIG. 2 is a drawing of an embodiment of the disclosed drywall sheet removal tool being used in removing a drywall sheet.

FIG. 2 illustrates the tool 100 during use. A wall 202 comprises a drywall sheet 204 (also referred to as a sheet rock), which covers at least one stud 206. First, a long opening 208 (e.g., a crack) is created along the width of the sheet 204. In some embodiments, the opening 208 is made with the bladed edges 112,114 of the tool 100. In other embodiments, another tool is used to create the opening 208. The opening 208, thus, divides the sheet 204 into an upper portion 204A and a lower portion 204B. The illustration of FIG. 2 shows the tool 100 being used to remove the lower portion 204B.

The tines 106,108 are then inserted into the opening 208 with the tines 106,108 straddling a stud 206. To remove the lower portion 204B, the tines 106,108 are inserted pointing downward. Once the tines 106,108 are fully inserted and the stud 206 rests against the cross bar 110, the handle 104 is moved upward in the direction of the arrow A. The tool 100 rolls around the curvature of the angle point 116 against the sheet 204A, causing the tines 106,108 to exert pressure and move in the direction of the arrow B. The pressure of the tines 106,108 against the sheet 204B causes the sheet 204B to separate from the stud 206.

In some embodiments, the handle 104 is at first rocked gently up and down to loosen the nails affixing sheet 204B to the stud 206. In certain embodiments, once the nails have somewhat loosened, the tool 100 is removed from the opening 208 and the nails are removed using the wedge 118.

To remove sheet 204B, the above process is repeated except for the tines 106,108 pointing upward. If sheet 204A has already been removed, then the angle point 116 is made to roll against the stud 206.

What is claimed is:

1. A drywall sheet removal tool, comprising:

a handle; and a plurality of tines spaced apart tines connected to a cross bar;

wherein the handle extends from the cross bar at an orientation substantially parallel to the plurality of tines around a bend portion to a distal end substantially perpendicular to the plurality of tines.

2. The tool of claim 1, wherein the tool comprises two tines.

3. The tool of claim 1, wherein each of the plurality of tines is flat.

4. The tool of claim 1, wherein each of the plurality of tines comprises a sharp bladed edge.

5. The tool of claim 1, wherein the handle is connected to the cross bar at an angle point.

6. The tool of claim 5, wherein the angle point is curved.

7. The tool of claim 1, wherein the angle between the line of the handle and the plane defined by the plurality of tines is 90°.

8. The tool of claim 1, wherein the cross bar includes a notch therein for gripping nail head.

9. The tool of claim 1, wherein the bend portion of said handle includes a bulge extending out of alignment with the distal end of the handle in a direction away from the plurality of tines.

* * * * *